US007775172B2

(12) United States Patent
Hansen

(10) Patent No.: US 7,775,172 B2
(45) Date of Patent: Aug. 17, 2010

(54) FOAM STABILIZED WATERCRAFT WITH FINNED COLLAR

(75) Inventor: William M. Hansen, Port Orchard, WA (US)

(73) Assignee: Safe Boats International L.L.C., Port Orchard, WA (US)

( * ) Notice: Subject to any disclaimer, the term of this patent is extended or adjusted under 35 U.S.C. 154(b) by 0 days.

(21) Appl. No.: 11/759,182

(22) Filed: Jun. 6, 2007

(65) Prior Publication Data

US 2008/0011215 A1 Jan. 17, 2008

Related U.S. Application Data

(60) Provisional application No. 60/811,523, filed on Jun. 6, 2006.

(51) Int. Cl.
*B63B 43/14* (2006.01)

(52) U.S. Cl. ..... 114/123

(58) Field of Classification Search ..... 114/345, 114/274, 292, 123, 126
See application file for complete search history.

(56) References Cited

U.S. PATENT DOCUMENTS

| | | | | |
|---|---|---|---|---|
| 2,375,973 | A * | 5/1945 | Cooper et al. | 114/292 |
| 3,065,724 | A | 11/1962 | Tritt | |
| 3,261,038 | A | 7/1966 | Klepper | |
| 4,060,864 | A | 12/1977 | Woolworth | |
| 4,060,865 | A | 12/1977 | Woolworth | |
| 5,228,407 | A | 7/1993 | Cummer | |
| 5,282,436 | A | 2/1994 | Hansen | |
| 5,647,297 | A | 7/1997 | Hansen | |
| 5,651,328 | A * | 7/1997 | Elkington | 114/345 |
| 5,870,965 | A * | 2/1999 | Hansen | 114/283 |
| 5,908,006 | A * | 6/1999 | Ibata | 114/284 |

(Continued)

FOREIGN PATENT DOCUMENTS

EP 0212141 A1 3/1987

(Continued)

OTHER PUBLICATIONS

"Nautical Safety Conference," Safety At Sea, Jun. 1985, pp. 13, 18, 40.

(Continued)

*Primary Examiner*—Stephen Avila
(74) *Attorney, Agent, or Firm*—Christensen O'Connor Johnson Kindness PLLC

(57) ABSTRACT

A watercraft (100) is disclosed having a rigid hull (110) and outboard stabilizing members (112) attached to the hull sides (116). The hull preferably has a V-shaped bottom (118) and comprises a planing hull. The stabilizing members are preferably foam stabilizers, but may alternatively be inflatable bladder members. The stabilizing members cover a portion of the hull sides, extending part way to the chine (120) defined between the hull sides and the hull bottom. The stabilizing members each include an elongate fin (130) that extends from a bottom surface of the stabilizing member, and disposed in a front portion of the stabilizing member and in the region of the greatest hull dead rise angle. The fins may be formed integrally with the stabilizing members or may attach to the stabilizing members. The fins define a channel between the hull sides and the fins, that is hydrodynamically pressurized during certain watercraft operations, an in particular during low speed maneuvering.

16 Claims, 3 Drawing Sheets

U.S. PATENT DOCUMENTS

| | | | | |
|---|---|---|---|---|
| 6,192,822 | B1 * | 2/2001 | Lavorata et al. | 114/345 |
| 6,371,040 | B1 | 4/2002 | Hemphill | |
| 6,460,477 | B1 | 10/2002 | Hamilton | |
| 6,807,920 | B1 * | 10/2004 | Wynne | 114/284 |
| 6,810,827 | B2 | 11/2004 | Hansen | |
| 6,871,612 | B2 | 3/2005 | Gursoy | |
| 7,070,730 | B2 | 7/2006 | Hansen | |
| 7,201,865 | B2 | 4/2007 | Hansen | |

FOREIGN PATENT DOCUMENTS

| | | | |
|---|---|---|---|
| EP | 0429107 | B1 | 4/1994 |
| FR | 2564415 | A1 | 11/1985 |
| GB | 2161118 | A | 1/1986 |
| GB | 2184984 | A | 7/1987 |
| GB | 2196717 | A | 5/1988 |
| GB | 2238025 | A | 5/1991 |
| JP | 31054383 | A | 3/1986 |
| SU | 1369985 | A | 1/1988 |

OTHER PUBLICATIONS

"Rescue Boats," Safety At Sea, Apr. 1990, pp. 17, 19.
"Rescue Boats," Safety At Sea, Jul. 1988, pp. 21-24.
"Rigid Inflatable Rescue Boats," Safety At Sea, Apr. 1987, pp. 26-27.
"Watercraft's New Rescue Boat," Safety At Sea, Oct. 1988, pp. 10-11.
Williams, S.G., "A New Chapter in the History of Lifeboat Development," Safety At Sea, Mar. 1985, pp. 12-15.

* cited by examiner

FOAM STABILIZED WATERCRAFT WITH FINNED COLLAR

CROSS-REFERENCE TO RELATED APPLICATION

This application claims the benefit of U.S. Provisional Patent Application No. 60/811,523, filed Jun. 6, 2006, the disclosure of which is hereby expressly incorporated by reference in its entirety, and priority from the filing date of which is hereby claimed under 35 U.S.C. §119.

BACKGROUND

An important improvement to the design of smaller, high-performance watercraft is the incorporation of a flotation devices in or on the hull that prevents the boat from sinking in virtually any accident scenario, and may additionally add stability to the boat performance during operation. Additionally, flotation devices provide the boat with added buoyancy, thus increasing carrying capacity and safety. The installation of flotation devices is especially important in the case of small boats which are designed for operation on rough waters, such as in the case of rescue boats.

Many prior art boat designs incorporate foam devices within the hull of the boat, as in U.S. Pat. No. 4,060,865 to Woolworth. Typically, the foam flotation members are incorporated directly within the hull structure itself. These boat designs are generally safer than designs which do not incorporate flotation devices within the hull.

Other prior art boat designs use inflatable cylinders to form the sides of the boat, as in the case of Zodiac® boats. The inflatable cylinders provide a high degree of stability to the boat but result in a loss of performance. Generally, prior art inflatable boat designs use inflatable cylinders as the sides of the boat and either a flexible floorboard or a rigid floorboard formed of wood or fiberglass. In operation, the cylinders serve as the running surface for the boat and remain in contact with the surface of the water; thus, a substantial wetted surface area and a significant amount of drag are created. This design also results in a very poor ride due to the fact that the boat tends to skip or bounce over the top of the waves. In addition, the inflatable cylinders are easily damaged and must constantly be inspected for tears, leaks, etc. Another disadvantage to inflatable boats is that typically the interior of the boat is very small, thus leaving little room for carrying equipment or passengers.

Another prior art design is a boat stabilized with outboard foam stabilizing members. Generally, such prior art designs use a rigid, planing hull having a transom and a pair of curved sides extending forwardly from the transom to form the bow of the watercraft. The sides and bottom of the hull are joined to form a chine. Foam stabilizing members are mounted on the sides of the hull above the chine and extend from the transom along the length of the hull to the bow. The stabilizing members extend outwardly from the sides of the hull so that they contact and displace an increasing volume of water as the boat lists. An example of a foam stabilized watercraft design is disclosed in U.S. Pat. No. 5,870,965, which is hereby incorporated by reference in its entirety.

As disclosed below, however, it has been found advantageous to provide a fin on the bottom surface of a forward portion of the stabilizing members to form a channel for providing hydrodynamic lift during certain watercraft operating conditions, as disclosed below.

SUMMARY

An improved watercraft of the type having a rigid hull and outboard stabilizers is disclosed. The hull in a disclosed embodiment is a planing hull having a V-shaped bottom and port and starboard sides that join the bottom in a chine, which may be a hard chine. Stabilizing members, which may be D-shaped foam or cylindrical inflatable bladders, are mounted to each wall, to stabilize the watercraft during operation. Prior art stabilizing members are known that stabilize the watercraft during high-speed maneuvering. In the present embodiment an inboard, lower edge of the stabilizing member is disposed above the chine, and the stabilizing members include a fin that extends from a lower surface of the stabilizing member to form a channel between the exposed portion of the sidewall and the fin. The fin preferably extends for only a portion of the length of the stabilizing member, for example from 30% to 50% of the length of the stabilizing member, and is located at an axial location where the hull dead rise angle is the steepest.

During certain operating conditions, a portion of the water displaced by the hull is directed toward the channel between the hull wall and the fin, thereby hydrodynamically pressurizing the channel, and generating a lifting force. For example, during low speed maneuvering the channel will become pressurized providing a righting force that will tend to counteract the watercraft's tendency to heel. During low speed operation in rough waters, pressurization of the channel will also contribute to a relatively soft ride.

In one embodiment the stabilizing members and fins are formed integrally from a polymeric foam, for example by an extrusion process, with post-extrusion processing.

In one embodiment the stabilizing members and fins are retained in a flexible membrane.

In one embodiment the fins extending from the bottom surface of the stabilizing member have a maximum height such that the lowermost bottom surface of the fin is approximately level with the chine.

In one embodiment the fin is tapered, having a forward end that is substantially flush with the stabilizing member, and gradually increasing in height to the maximum fin height.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
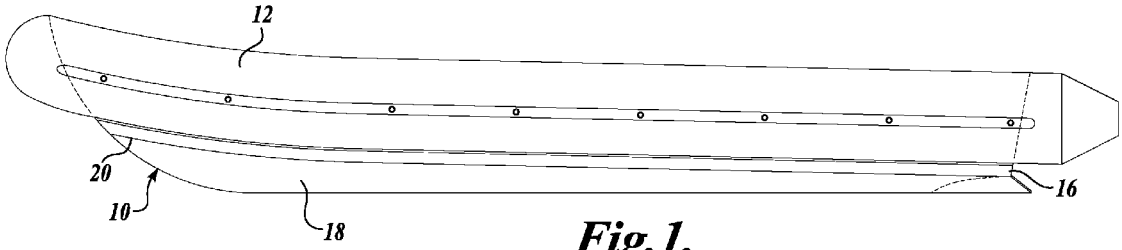
Fig.1. (PRIOR ART)
FIG. 1 is a side elevational view of a prior art foam stabilized watercraft suitable for application of the present invention.
Figure 2:
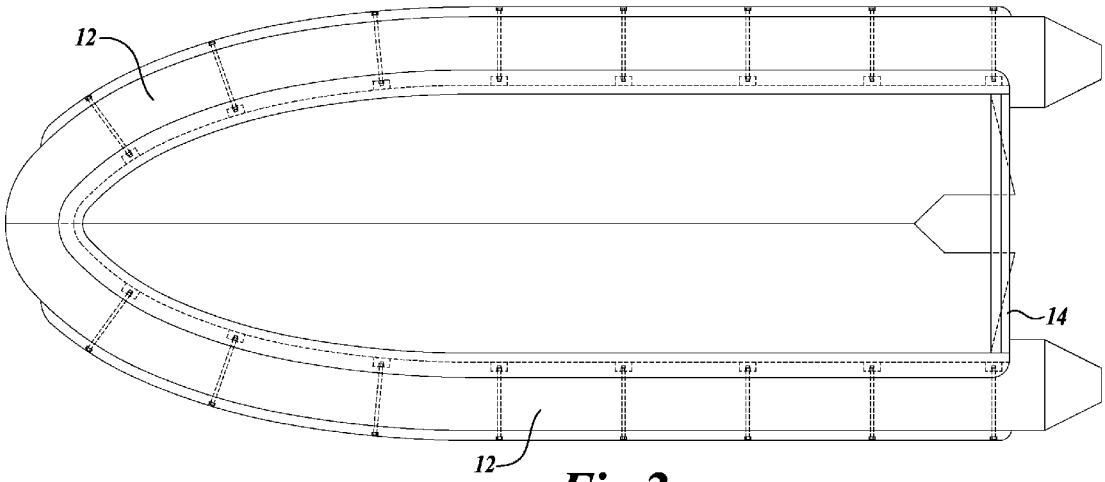
Fig.2. (PRIOR ART)
FIG. 2 is a top plan view of the watercraft shown in FIG. 2.

FIG. 1 is a side view of a prior art, foam stabilized watercraft that is suitable for application of the improvements to the stabilizers as taught by the present invention. A plan view of the watercraft is shown in FIG. 2. The watercraft includes a rigid hull 10 and two oppositely curved stabilizing members 12 located on the sides of the hull 10. The rigid hull 10 may be formed of aluminum, fiberglass, or any other suitable material that can withstand the harsh and corrosive environment encountered by boat hulls. In FIG. 1 the hull 10 is designed to be a high-performance hull. The hull includes a transom 14, two sides 16 extending forward from the stem and curving toward each other to define the bow of the hull 10, and a bottom 18. The sides 16 are joined to the bottom 18 of the watercraft and to the sides of the transom 14 such that a hard chine 20 is formed at the intersection between the sides and the bottom of the watercraft.

Figure 3:
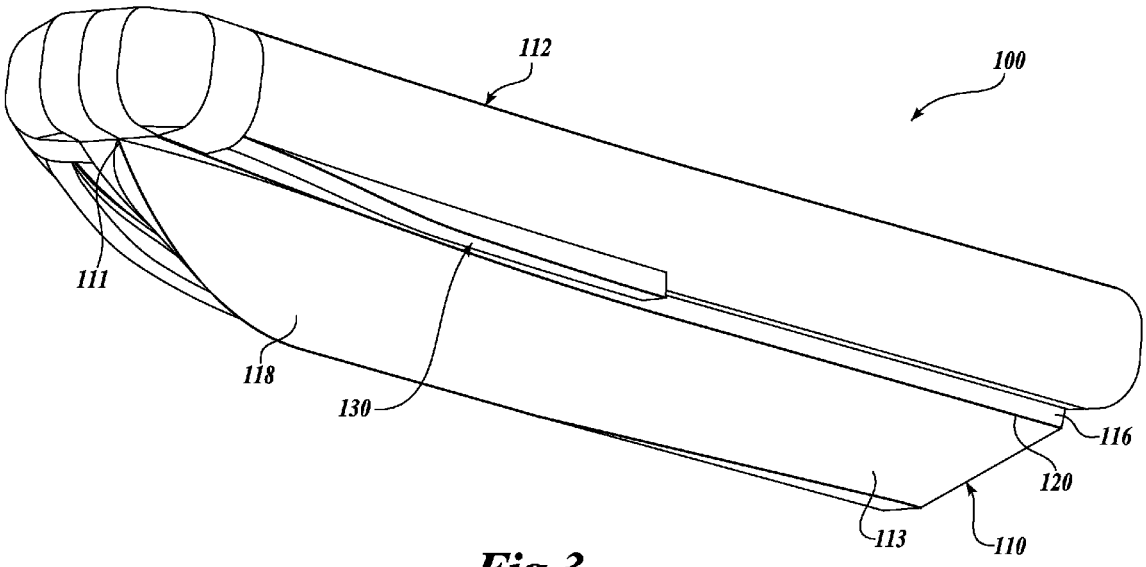
FIG. 3 is a perspective lower left side view of a watercraft similar to the watercraft shown in FIG. 1, but with an improved stabilizing member having a forwardly disposed fin in accordance with the present invention.
Figure 4:
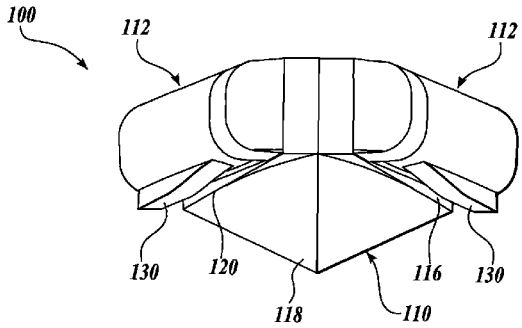
FIG. 4 is a front view of a watercraft shown in FIG. 3.
Figure 5:
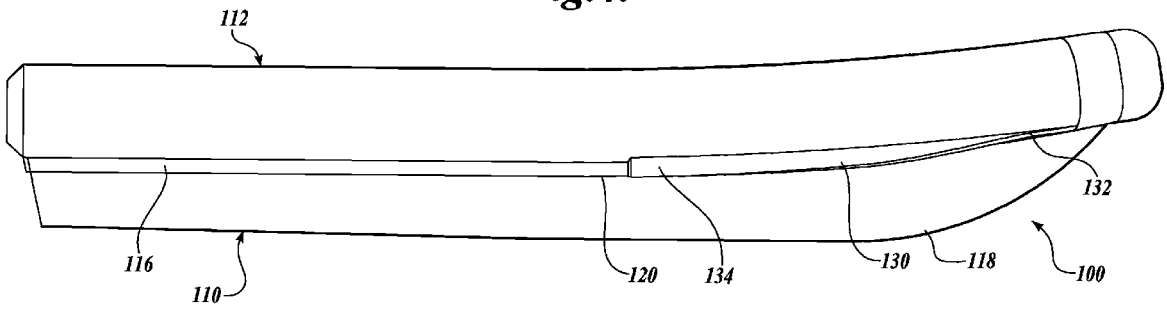
FIG. 5 is a side view of the watercraft shown in FIG. 3.

FIG. 3 is a left side perspective view of a watercraft 100, similar to the watercraft shown in FIGS. 1 and 2, but with improved stabilizer members 112 (one visible) to provide improved performance and a softer ride. A front view of the watercraft 100 is shown in FIG. 4, and side view of the watercraft is shown in FIG. 5.

The watercraft 100 is a foam-stabilized or air-stabilized watercraft 100 having a rigid hull 110. The hull 110 includes a generally V-shaped bottom 118. The angle that the hull bottom 118 forms (with respect to horizontal), referred to as the dead rise angle, is generally steeper near the bow 111 of the hull 110 than in the stemward portion 113 of the hull 110. The hull 110 is preferably a planing hull, wherein at higher speeds the bow of the hull lifts out of the water, decreasing thereby the hydrodynamic drag. Sides 116 (only a small portion of one side 116 is visible in FIG. 3) meet the bottom 118 at an angle, preferably at a relatively sharp angle, forming a hard chine 120.

External stabilizing members 112 are mounted to the hull sides 116. Although the stabilizing members 112 are disposed on both the port and starboard sides of the watercraft 100 and sometimes referred to separately, it will be appreciated that the stabilizing members 112 may be formed together, or assembled as an integral unit. The stabilizing members 112 preferably extend along the entire length on either side 116 of a rigid hull 110.

The stabilizing members 112 are similar to the foam stabilizing members 12 described above wherein the foam stabilizing members 12 are generally D-shaped in cross-section with a relatively flat portion disposed against the sides 16 of the watercraft. However, the stabilizing members 112 define oppositely disposed performance enhancing fins 130 that extends along a curved, forward portions of the stabilizing members 112. The fin 130 is sized and positioned to take advantage of the hydrodynamic forces generated as the watercraft 100 is underway, as discussed below, and are preferably curved to be approximately uniformly distant from the hull side 116.

The stabilizing member 112 is preferably formed from plastic foam, which may be coated with or otherwise encapsulated in a harder plastic shell, or more preferably covered and retained in a flexible membrane. A currently preferred membrane is formed from a polyurethane-coated polyester tube. Although foam stabilizing members 112 are preferred, it will be readily apparent that the present invention may also be practiced in watercraft using an air-bladder type stabilizing member.

The stabilizing members 112 are attached to the sides 116 of the watercraft 100 in any convenient manner. The attachment mechanism disclosed in the previously incorporated U.S. Pat. No. 5,870,965, also by the present inventor, is believed to be particularly advantageous because it does not require that any hardware penetrate the rigid hull 110. The stabilizing members 112 are sized such that the lower inboard edge of the stabilizing member 112 is disposed above the hard chine 120, and therefore a lower portion of the hull sides 116 are not covered by the stabilizing members 112.

As discussed above, prior art outboard stabilizing members generally have a relatively smooth, cylindrical or curved lower surface, or at least a so-called non-trip chine, wherein the lower surface does not include any sharp angles. In the present stabilizing member 112, in contrast, the lower surface of the stabilizing member 112 includes an elongate fin 130 that projects from the lower surface, and extends generally from a location near the front of the stabilizing member 112 rearwardly. If the stabilizing member 112 is formed from a polymeric foam, for example, the fin 130 may be formed as an integral part of the stabilizing member 112. Alternatively, the stabilizing fin 130 may be formed as a separate component, perhaps from a different material, and attached to the stabilizing member 112.

Although it is contemplated that the elongate fin 130 could extend along the entire length of the stabilizing member 112, in the preferred embodiment shown in the FIGURES the fin 130 extends from near the front of the stabilizing member 112 along a portion of the stabilizing member 112 that curves about the front of the hull 110, extending along approximately 30-50% of the length of the stabilizing member 112. The height of the fin 130 is tapered, gradually increasing from a minimum thickness at the forward end 132 of the fin 130, to a design height at an intermediate location, and maintaining the design height to the aft end 134 of the fin 130. Of course, the fin 130 may gradually taper along the trailing edge, if desired.

As seen most clearly in the front view of FIG. 4, the fin 130 maximum design height is approximately equal to the width of the portion of the hull sides 116 that is not covered by the stabilizing member 112, i.e., so that the bottom surface the fin 130 at the widest portion is approximately level with the hard chine 120. It will also be appreciated that the forward position of the fin 130 locates the fin 130 axially at the location where the dead rise angle in the hull bottom 118 is the steepest. The fin 130 is preferably curved in the longitudinal direction, to follow the contour of the hull side 116, thereby forming a relatively constant channel width therebetween.

The fin 130 provides significant performance advantages to the watercraft 100, and in particular provides a righting moment to reduce heeling during low-speed turns, and generally softening the ride during other operating conditions. The inventor's current theory regarding the reasons for the improved performance will now be discussed, to aid the reader in understanding the hydrodynamics of the improvement. When the watercraft 100 is underway, displaced water flows over and about the hull 110 as the watercraft is propelled through the water. In particular, the V-shaped hull bottom 118 forces water upwardly and rearwardly generally along the hull surface. The upward flow will generally be greatest where the dead rise angle is largest. When the fin 130 is at or near the surface of the water, for example during relatively low-speed turns (when the planing hull is not significantly lifted out of the water) this flow produces a high-pressure region in the channel defined between the hull side 116 and the fin 130, generating a lift or upward force on the hull 110. This high-pressure region will tend to counter the tendency of the watercraft 100 to heel during turns and is particularly effective during hard or drastic low speed turns or maneuvers, providing a more stable ride. The fin 130 uses the dynamic pressure from the relative motion of the hull 110 to generate an upward force that acts against the tendency of the boat to heel during the turn.

It is also an advantage to form the fins 130 from a polymeric foam material, for example the material used for making foam stabilizing members. The fins may be formed integrally with the stabilizing members 112. The fins 130 will therefore be pliable and compressible, reducing the risk of damage, for example from minor collisions with flotsam, docks, and the like.

It will be appreciated also that it is desirable that the fins 130 do not extend downwardly beyond, or at least not significantly beyond, the hard chine 120. The pressurization in the channel between the hull 110 and the fins 130 will not be significant below the chine 120, and it is desirable that the fins 130 not contact the water surface during high speed operations, for obvious reasons.

It is believed that the fins 130 also disrupts the laminar flow of water interacting with the hull 110 and the stabilizing member 112, increasing the local turbulence, further reducing the tendency of the watercraft 100 to heel. The combination of these phenomena act against the tendency of the watercraft to heel excessively, allowing a rapid turn to occur in a safe manner, and reducing the chance of capsizing the watercraft 100 or of taking water over the side.

In addition, these same hydrodynamic effects assist in creating what is known or referred to as a 'softer ride'. During operation of the watercraft, at any speed through chop or wakes, the pressurization or lift generated about the fins 130 help to reduce the physical impact of the hull 110 onto the water as it crosses through chop or otherwise disturbed water. The pressurization in the channels between the hull sides 116 and the fins 130 is believed to act as a sort of shock absorber in such conditions.

Referring again to the FIGURES, it is contemplated that the fin 130 may be formed integrally with a foam stabilizing member 112, for example in an extrusion process, or physical shaping process such as cutting or otherwise removing material. Alternatively, the fins 130 may be attached directly to the stabilizing member 112, for example as an insert that penetrated into the stabilizer or by direct adhesion thereto.

Alternatively, a rigid or semi-rigid stabilizing member cover may be formed comprising a generally cylindrical portion that is sized and adapted to fit over, and engage, a conventional stabilizing member and having a fin extending generally downwardly therefrom. The stabilizing member that engages the stabilizer cover may be a foam member, an air bladder, or a combination thereof. The fin portion of such a cover may be formed as a hollow, substantially rigid portion or may be a solid fin, for example formed from a polymeric foam or the like. The stabilizer cover may attach to the stabilizer in any number of ways, as are well known in the art, including attachment with mechanical attachment mechanisms such as removable bolts, straps, or rivets, or by use of an adhesive, for example.

It will be appreciated that the particular size, shape and length of the fin 130 may be tailored to a particular hull for optimal results, or a more generic fin may be utilized that is applicable to different hull shapes. It will also be appreciated that the fin 130 may extend at an angle from the stabilizer, other than perpendicularly therefrom, depending on the particular application. Although a fin 130 having a generally rectangular cross-section is shown in the FIGURES, it is contemplated that the fin cross section may be alternatively shaped. For example, the bottom surface of the fin 130 may be oriented such that the surface is substantially parallel to the water when the watercraft heels far enough for the fin to engage the water surface.

While illustrative embodiments have been illustrated and described, it will be appreciated that various changes can be made therein without departing from the spirit and scope of the invention.

The embodiments of the invention in which an exclusive property or privilege is claimed are defined as follows:

1. A watercraft comprising:

a rigid hull having a V-shaped bottom and oppositely disposed sides, the sides forming a chine with the V-shaped bottom;

first and second stabilizing members attachable to the hull sides, the stabilizing members having a lower surface defining an inboard edge that is disposed adjacent the hull side and above the chine, each stabilizing member further comprising an elongate fin extending downwardly from a forward portion of the lower surface of the stabilizing member, the fin oriented longitudinally along the forward portion of the stabilizing member and generally uniformly spaced from the hull side to define a channel therebetween, the channel comprising an inboard side along the hull above the chine, an upper side along a bottom portion of the stabilizing member, and an outboard side defined by the fin, and further wherein the fin is positioned along a forward portion of the hull and extends along not more than 50% of the length of the stabilizing member.

2. The watercraft of claim 1, wherein the first and second stabilizing members are formed from a polymeric foam.

3. The watercraft of claim 2, wherein the fins are formed integrally with the stabilizing members.

4. The watercraft of claim 3, wherein the fins and stabilizing members are coextruded.

5. The watercraft of claim 3, wherein the stabilizing members are retained in a flexible membrane.

6. The watercraft of claim 1, wherein the fins have a maximum height such that the fins do not extend downwardly beyond the hull chine formed by the hull sides and V-shaped bottom.

7. The watercraft of claim 5, wherein the fins have a tapered leading edge defining a front end that is flush with the stabilizing member and a maximum height at an intermediate location.

8. The watercraft of claim 1, wherein the fins are located at an axial location adjacent to the maximum dead rise angle of the V-shaped bottom of the hull.

9. The watercraft of claim 1, wherein the stabilizing members have a length, and the fins extend for approximately 30%-50% of the stabilizing member length.

10. The watercraft of claim 1, wherein the first and second stabilizing members are formed together as an integral unit.

11. The watercraft of claim 1, wherein the fins are positioned such that the channel between the fins and the hull sides will be hydrodynamically pressurized to produce a righting moment when the watercraft heels during a low speed turn.

12. An improvement to a watercraft of the type comprising a rigid planing hull having a bottom and port and starboard sides defining a chine therebetween, and outboard port and starboard foam stabilizing members, the improvement comprising:

oppositely disposed elongate fins extending from a lower surface of each of the port and starboard stabilizing members, the fins extending axially along a forward portion of the stabilizing members, and wherein the fins extend vertically downward at least to the chine defined by the hull to define a channel between the fin and the hull, the channel comprising an inboard side along the hull above the chine, an upper side along a bottom portion of the stabilizing member, and an outboard side defined by the fin, wherein the channel has a uniform width and is disposed along a forward portion of the hull and extends along not more than 50% of the length of the stabilizing member.

13. The watercraft of claim 12, wherein the fins are formed integrally with the port and starboard foam stabilizing members.

14. The watercraft of claim 12, wherein the stabilizing members and the fins are retained in a membrane.

15. The watercraft of claim 12, wherein the fins extend approximately 30%-50% of the length of the stabilizing members.

16. The watercraft of claim 12, wherein the fins are positioned such that the channel between the fins and the hull sides will be hydrodynamically pressurized to produce a righting moment when the watercraft heels during a low speed turn.

* * * * *